US011842872B2

(12) United States Patent
Fleitmann et al.

(10) Patent No.: US 11,842,872 B2
(45) Date of Patent: Dec. 12, 2023

(54) SWITCHING DEVICE WITH INTERFACE MODULE

(71) Applicant: Eaton Intelligent Power Limited, Dublin (IE)

(72) Inventors: Gregor Fleitmann, Kerpen (DE); Hans-Juergen Mader, Dieblich (DE); Daniel Andreas Jansen, Bonn (DE); Rolf Arck, Niederkasse (DE); Ralph Kriechel, Alfter (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 134 days.

(21) Appl. No.: 16/170,065

(22) Filed: Oct. 25, 2018

(65) Prior Publication Data

US 2019/0131099 A1 May 2, 2019

(30) Foreign Application Priority Data

Oct. 27, 2017 (DE) ..... 102017125308.4

(51) Int. Cl.

| | |
|---|---|
| ***H01H 71/10*** | (2006.01) |
| ***H01H 71/02*** | (2006.01) |
| ***H01H 71/74*** | (2006.01) |
| ***H01H 71/04*** | (2006.01) |
| *H01H 9/16* | (2006.01) |
| *H01H 83/20* | (2006.01) |

(52) U.S. Cl.

CPC ..... *H01H 71/10* (2013.01); *H01H 71/0228* (2013.01); *H01H 71/04* (2013.01); *H01H 71/74* (2013.01); *H01H 9/167* (2013.01); *H01H 2071/048* (2013.01); *H01H 2083/203* (2013.01)

(58) Field of Classification Search

CPC ..... H01H 2300/04; H01H 71/10; H01H 71/00–2071/749

See application file for complete search history.

(56) References Cited

U.S. PATENT DOCUMENTS

| | | | | |
|---|---|---|---|---|
| 6,392,422 | B1 | 5/2002 | Kammer et al. | |
| 7,812,696 | B2 | 10/2010 | Hartinger et al. | |
| 2005/0087430 | A1 | 4/2005 | Ette et al. | |
| 2006/0254893 | A1 * | 11/2006 | Mills | H01H 71/04 200/313 |

(Continued)

FOREIGN PATENT DOCUMENTS

| | | | |
|---|---|---|---|
| CN | 1835337 | A | 9/2006 |
| CN | 102024583 | A | 4/2011 |

(Continued)

*Primary Examiner* — Jared Fureman
*Assistant Examiner* — Christopher J Clark
(74) *Attorney, Agent, or Firm* — LEYDIG, VOIT & MAYER, LTD.

(57) ABSTRACT

A switching device includes: a triggering unit; an actuator coupled to the triggering unit; a switching mechanism coupled to the actuator; and an interface module. The interface module includes: a signal processing unit coupled to the triggering unit; an interface circuit coupled to a transmitting and receiving circuit of the signal processing unit; a power supply input for feeding a first supply voltage; and a voltage converter connected on an input side to the power supply input and a power outlet for issuing a second supply voltage. The power outlet is coupled to the signal processing unit and to the triggering unit.

19 Claims, 5 Drawing Sheets

(56) References Cited

U.S. PATENT DOCUMENTS

| | | | | |
|---|---|---|---|---|
| 2012/0092802 | A1* | 4/2012 | Weiher | H02H 3/08 361/96 |
| 2013/0148249 | A1* | 6/2013 | Schlotterer | H01H 71/123 361/115 |
| 2014/0118875 | A1* | 5/2014 | Carlino | H01H 71/74 361/93.2 |
| 2014/0305906 | A1* | 10/2014 | Baek | H01H 33/08 218/156 |
| 2015/0380145 | A1* | 12/2015 | Koch | H01H 1/20 335/282 |

FOREIGN PATENT DOCUMENTS

| | | | |
|---|---|---|---|
| CN | 203502556 | U | 3/2014 |
| CN | 106229228 | A | 12/2016 |
| DE | 19826410 | A1 | 1/1999 |
| DE | 102004062266 | A1 | 7/2006 |
| DE | 102007026512 | A1 | 12/2008 |
| DE | 10253018 | B4 | 2/2013 |
| DE | 102014212132 | A1 | 12/2015 |
| WO | WO 2003038963 | A2 | 5/2003 |

* cited by examiner

SWITCHING DEVICE WITH INTERFACE MODULE

CROSS-REFERENCE TO PRIOR APPLICATION

Priority is claimed to German Patent Application No. DE 10 2017 125 308.4, filed on Oct. 27, 2017, the entire disclosure of which is hereby incorporated by reference herein.

FIELD

The present disclosure relates to a switching device with an interface module.

BACKGROUND

A switching device can be implemented as a circuit breaker, a motor protection switch, power safety switch or a load disconnection switch. A switching device typically comprises a triggering unit, an actuator and a switching mechanism. The triggering unit is coupled to the switching mechanism through the actuator. Since more and more bus systems are being used in systems technology, it is also a necessity for a switching device to be easy to connect to a bus.

Being able to provide a switching device, which facilitates ease of connection to a bus, is an objective here.

SUMMARY

In an embodiment, the present invention provides a switching device, comprising: a triggering unit; an actuator coupled to the triggering unit; a switching mechanism coupled to the actuator; and an interface module, comprising: a signal processing unit coupled to the triggering unit; an interface circuit coupled to a transmitting and receiving circuit of the signal processing unit; a power supply input configured to feed a first supply voltage; and a voltage converter connected on an input side to the power supply input and a power outlet configured to issue a second supply voltage, the power outlet being coupled to the signal processing unit and to the triggering unit.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1A:
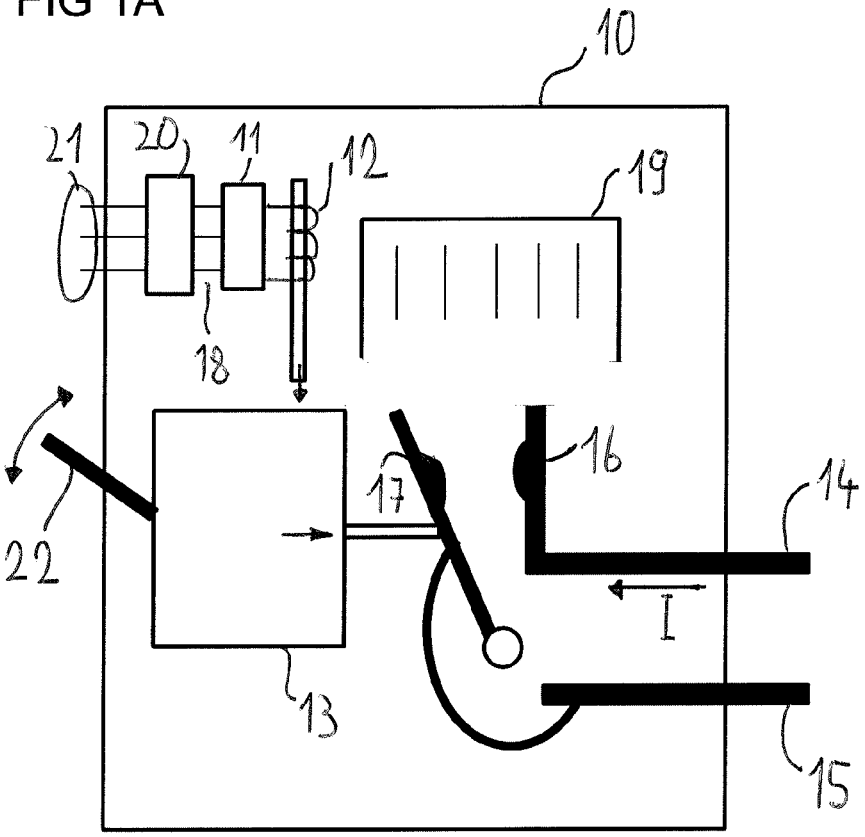
FIGS. 1A and 1B Examples of a switching device.

In one embodiment, a switching device comprises a triggering unit, an actuator coupled to the triggering unit, a switching mechanism coupled to the actuator and an interface module. The interface module comprises a signal-processing unit which is coupled to the triggering unit, an interface circuit which is coupled to a transmitting and receiving circuit in the signal processing unit, a power supply input for feeding a first power supply and a voltage converter, which is connected to the input side of the power supply inlet and comprises a power outlet for issuing a second power supply. The power outlet is coupled to the signal processing unit and the triggering unit.

The advantage of this is that the switching device can be connected to a bus by way of the interface module. In an example, the interface module supports at least one bus protocol. The switching device can issue data to the bus and receive data from the bus by way of the signal processing unit and the interface circuit. The bus can be connected directly to the interface circuit or coupled to the interface circuit.

The interface module can also be identified as a switching circuit status module, also known as a breaker status module, or BSM.

In one embodiment, the signal processing unit is implemented as a micro-controller or a microprocessor.

In one embodiment, the transmitting and receiving circuit in the signal processing unit is designed to convert a serial data signal into a parallel data signal. The transmitting and receiving circuit can be designed to convert a serial data signal issued by the interface circuit to a parallel data signal, which is further processed by the additional blocks in the signal processing unit. These additional blocks can be a central unit, or central processing unit (CPU), and/or a memory unit. Likewise, the transmitting and receiving circuit can be designed to convert a parallel data signal—provided by the additional blocks in the signal processing unit—into a serial data signal, which is then fed into the interface circuit. This serial data signal is thus an output signal from the interface module and can be fed through a bus line to a bus module or adapter module in the switching device, or through the bus line to an external unit, such as a higher-level communication unit.

In one embodiment, the transmitting and receiving circuit in the signal processing unit comprises a universal asynchronous receiver-transmitter and/or a universal synchronous/asynchronous receiver-transmitter. Thus the advantage is that the transmitting and receiving circuit can convert data provided by the other blocks in the signal processing unit into a serial bit signal and issue the data to the interface circuit. Furthermore, the transmitting and receiving circuit can also convert a serial bit signal—which is fed through the interface circuit in the signal processing unit—into bytes of data, which are processed by the other blocks in the signal processing unit.

In one embodiment, the voltage converter is implemented as a DC/DC converter. A voltage value from the first power supply is greater than a voltage value of the second power supply.

In one embodiment, the voltage converter is implemented as a step-down converter. Alternatively, the voltage converter can be implemented as a step-down/step-up converter.

In one embodiment, the interface module comprises a detection unit which is coupled to the signal processing unit on the output side and is designed to convert position information to an electrical detection signal.

In one embodiment, the detection unit is designed to optically detect the position of an actuator in the switching device and to convert it into an electrical detection signal. The actuator is coupled to the switching mechanism. The actuator is accessible to a user. The actuator can be a toggle switch or a pressure switch. Therefore, the position of the actuator can be detected by the detection unit, converted into an electrical detection signal, thereby sending information about the position of the actuator via the signal processing unit, the interface circuit and a bus in a communication unit that is external to the switching device, or the trip unit of a switching device.

In one embodiment, the interface module comprises a voltage divider with a first connector, a second connector and a voltage divider tap. The first connector is connected to a neutral conductor or can be connected to a neutral conductor. The voltage divider tap is coupled to the triggering unit via an input port. The second connector can be connected to a reference potential conductor or a reference potential connector. An advantage here is that the voltage can be monitored on the neutral conductor.

For example, the switching device can be set to an operating or maintenance mode.

In one embodiment, the interface module comprises a control input circuit for feeding in a control signal. The signal processing unit is coupled to the control input circuit and is designed to adjust the protection function of the switching device, depending on the control signal. The switching device can include a mechanically-actuated switch for generating the control signal. The switching device is set to maintenance mode or operating mode, depending on the control signal. For example, the switching device's protection function can be enhanced in maintenance mode. This has the advantage that, when maintenance is being performed on an electrified load that is being fed through the switching device, personal safety is increased. This type of switch can be abbreviated as ARMS (arc reduction maintenance setting switch) or ERMS (energy reduction maintenance setting switch).

In one embodiment, the interface module comprises an interlocking circuit, which is coupled to a connector on the interface module for receiving and/or transmitting an interlocking signal, and which is coupled to the triggering unit. Using the actuator and the switching mechanism, the triggering unit interrupts or enables a flow of current, depending on the interlocking signal. The interlocking signal can be identified as a zone-selective interlocking signal. For example, the interlocking signal can comprise a signal from a group consisting of an interlocking input signal, an interlocking output signal and an additional interlocking signal. The switching device can be coupled to other switching devices by way of the interlocking signal. Zone-selective interlocking is abbreviated as ZSI.

Pursuant to the way zone-selective interlocking works, this switching device—which is directly upstream from the load—interrupts the current to a fault-causing load. If this switching device can successfully interrupt the current flow, other switching devices will not interrupt their own current flow. This ensures that it is not the switching device that is the quickest to reach a triggering condition that interrupts the current, but rather the switching device that directly supplies the power to the load causing the fault.

For example, the interlocking circuit communicates with the triggering unit of the switching device in which the interlocking circuit is located and with the interlocking circuits of other switching devices and/or a higher-level communication unit. The information provided by the triggering unit in the interlocking circuit's switching device, along with the information provided by the external switching devices in the communication unit, determines the locking circuit—the triggering unit interrupts the current or allows it to flow, by means of the switching mechanism and the actuator.

In one embodiment, the switching device comprises a housing unit. The triggering unit, the actuator, the switching mechanism and the interface module are contained inside the housing unit. This housing unit can be designed to be openable. The housing unit can, for example, be opened at the front. The housing unit can be opened even if it is installed in an arrangement similar to that of a control cabinet. The housing unit can be openable for maintenance purposes. The housing unit can be opened so that a person can remove the interface module from the switching device. For example, a person can remove the interface module from the switching device for maintenance or repair purposes, and can install a different interface module in the switching device. This is why the housing unit is designed so that it can be opened from the front.

In one embodiment, the triggering unit comprises another signal processing unit that is coupled to the signal processing unit of the interface module and to the actuator. The other signal processing unit is designed as a microprocessor, micro-controller, logic gate and/or a state machine. Thus, the switching device comprises at least two signal processing units.

The switching device includes a modular internal interface and a signalization unit.

The interface module is also known as a switching circuit status module, or breaker status module (BSM). The triggering unit can include triggering electronics. The switching device can be designed as a protective device and/or circuit breaker. The switching mechanism can be called a contact system.

The BSM is an internal interface between the triggering unit of the switching device and other modular communication units. The BSM serves to detect the switching position or mechanism of the contact system and to report this to the electronics of the switching device, in particular to the triggering unit.

In one embodiment, the triggering unit (also called a trigger) detects the operating conditions, i.e. the current through the switching device, and acts accordingly on the switching mechanism through one or more actuators (for example a coil) in order to open the switching device contact system in the event of an overload or short-circuit, depending on the load and corresponding default settings.

Notably, in a switching device with an electronic triggering unit, the load conditions in the system or the switching device can be detected and corresponding load states can be reported from or to the switching device. It is advantageous that the BSM can interact with external equipment. The BSM is designed to interact with various communication methods and protocols. It interacts electrically with the triggering unit in the switching device.

In one embodiment, an external signaling or communication unit connected directly to the switching device and attached to the housing outside of the switching device may be dispensed with.

In one embodiment, there is no need for additional space to install the BSM in the switching device since available free space can be used. Due to the spatial proximity of the BSM and the other parts of the switching device, the wiring within the switching device is minimal.

The BSM assumes the signalization function and accommodates the internal communication in the housing of the switching device. The BSM supports at least one bus protocol. Alternatively, the signalization function from the BSM is channeled through a dedicated bus protocol. To this end, the BSM can be coupled to an adapter module or a bus module through the dedicated bus protocol. The adapter module or the bus module can be set up in the housing of the switching device, for example, or directly outside the housing of the switching device. The bus module can be fastened to the outside of the switch device housing, using a clip connection. Here, the BSM is an internal interface between the triggering unit of the circuit breaker and another modular communication unit. The adapter module or the bus module can be designed as internal communication modules. Thus, internal communication modules can be connected to the BSM through an internal interface.

The BSM, the adapter module or the bus module can be designed for at least one communication protocol, such as MODBUS RTU communication, Modbus TCP, Ethernet, Profibus, Profibus DP, ProfiNet and/or Smart-Wire. The BSM and associated internal communication module use the available installation spaces and interfaces in the switching device. This makes it possible to create space-saving combinations in the layout of conventional auxiliary switches inside a control cabinet, for example. The adapter module or the bus module can be installed independent of the BSM in the switching device. The BSM can be coupled to various embodiments of an adapter module or bus module.

The BSM provides a range of electrical interfaces to the triggering unit, such as a 24 volt power supply, signal inputs for signal selectivity (shortened to ZSI) or as a protection function in the case of maintenance (shortened to ARMS) and/or as an external voltage tap. The BSM implements a combination of functions. Further, the detection unit of the BSM detects the signal states of the switch mechanism and the contact system through existing interfaces. The detection unit carries out the detection optoelectronically, for example, using an optical detector such as a light barrier, using a microswitch or other components.

The BSM can therefore be used modularly in switching devices of various sizes. This has the advantage of offering the possibility to connect the BSM to the electronics in the switching device, i.e. to the triggering unit, for example, via a plug-in multi-pin cable. Standard plugs are fixed in the electronics housings by means of specific brackets (plug-in adapters) that are either positively locked or frictionally locked to the circuit board.

For data transfer between the triggering unit and the BSM or between the BSM and the communication module, an internal data protocol is used, for example.

FIG. 1A shows an example of a switching device (10). The switching device (10) can be implemented as a circuit breaker, a motor protection switch, power safety switch or a load disconnection switch. The switching device (10) comprises a triggering unit (11), an actuator (12) and a switching mechanism (13). The switching device (10) further comprises a first and a second connection (14, 15) which are connected to a fixed and a moving contact (16, 17) on the switching device (10). The triggering unit (11) is coupled to the actuator (12) on the output side. The actuator (12) can be an electromechanical actuator. The actuator (12) can be implemented as a coil or a piezoelectric element, for example. The actuator (12) generates a force which acts on the switching mechanism (13). If the actuator (12) is implemented as a coil, the coil generates a magnetic field which acts on the switching mechanism (13). The switching mechanism (13) is designed to disconnect the moving contact (17) from the fixed contact (16). Further, the switching mechanism (13) is designed to connect the moving contact (17) to the fixed contact (16) so that a current (I) flows through the first and the second connection (14, 15). Thus, the triggering unit (11) is configured to disconnect the moving contact (17) from the fixed contact (16), using the actuator (12) and switching mechanism (13) to interrupt the current (I) or bring the moving contact (17) into contact with the fixed contact (16) and thus enable the flow of the current (I).

Further, the switching device (10) can comprise an extinguishing chamber (19), which is provided to extinguish a light arc between the moving contact and the fixed contact (16, 17).

In addition, the switching device (10) comprises an interface module (20). The interface module (20) is coupled to the triggering unit (11) by way of a lead configuration (18) on the switching device (10). Further, the interface module (20) is connected via connector ports (21) on the switching device (10).

The switching device (10) also comprises an activator (22), which acts on the switching mechanism (13). The activator (22) is designed so that a person can use the activator (22) to bring the moving contact (17) into contact with the fixed contact (16) or to separate the moving contact (17) from the fixed contact (16).

Figure 1B:
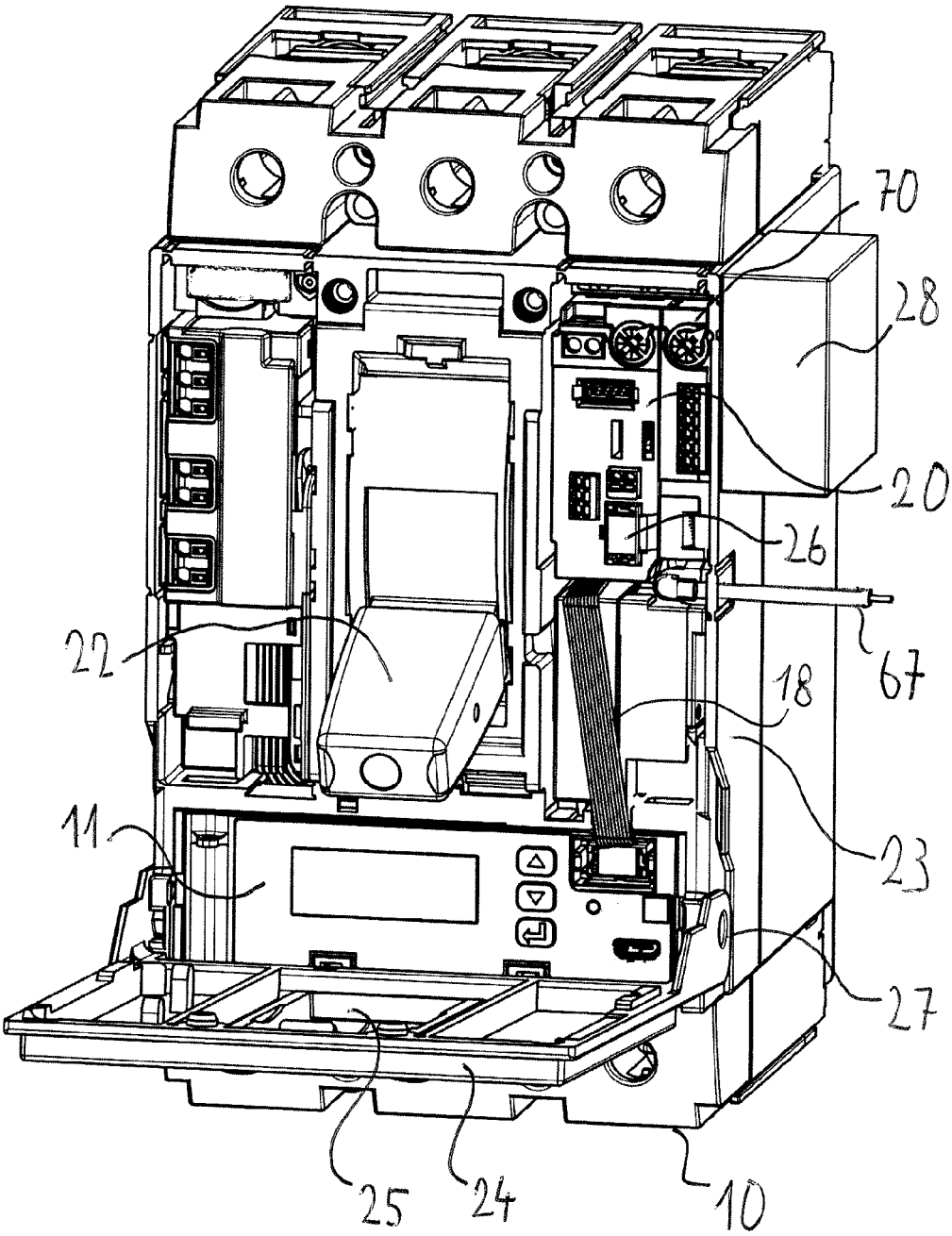

FIG. 1B shows an example of the switching device (10) as an improvement of the switching device shown in FIG. 1A. In FIG. 1B, it is the front side of the switching device (10) which is shown. The switching device (10) comprises a housing unit (23). The housing (23) can be opened by a person. To this end, the housing (23) comprises a moving cover (24) at the front side of the switching device (10). The moving cover (24) has an opening (25) so that a person has access to the activator (22). The cover (24) is connected to the other parts of the housing (23) by way of a hinge (27).

On the front side of the switching device (10) are the triggering unit (11), a bus module (70) and the interface module (20). The interface cables (26) connect the interface module 20 to the bus module 70. The interface cables (26) are part of the connector ports (21) on the interface module (20). The interface cables (26) can comprise electrical conductors and/or optical conductors. The electrical conductors can be implemented as cabling. The optical conductors can be implemented as glass-fiber cabling or light guides. The interface module (20) can be fastened to the switching device (10), for example using a clip connector or a hook connector with a fuse. The interface module (20) can be set up at the point of one or more auxiliary switches, for example in the space of one or more possible auxiliary switches in the switching device (10). On the back of the switching device (10) is a mounting bracket that allows the switching device (10) to be fitted into a control cabinet. Laterally, a connection cable (67) leads away from the switching device (10). The connection cable (67) can be connected to a neutral conductor. The connection cable (67) is connected to a voltage divider (65) on the interface module (20), as is seen in more detail in FIG. 2A.

The switching device (10) can comprise an additional housing unit (28) as an option. The additional housing (28) is fastened laterally to housing unit (23). The bus module (70) or an adapter module can be placed inside the additional housing unit (28). This additional housing (28) can be provided when the available design space inside the main housing unit (23) is not enough for the bus module (70) or the adapter module (for example, if an Ethernet jack is to be integrated into the bus module (70) or the in the adapter module). The bus module (70) and the adapter module are explained in more detail in FIG. 2A.

Alternatively, the additional housing (28) can be left out.

Figure 2A:
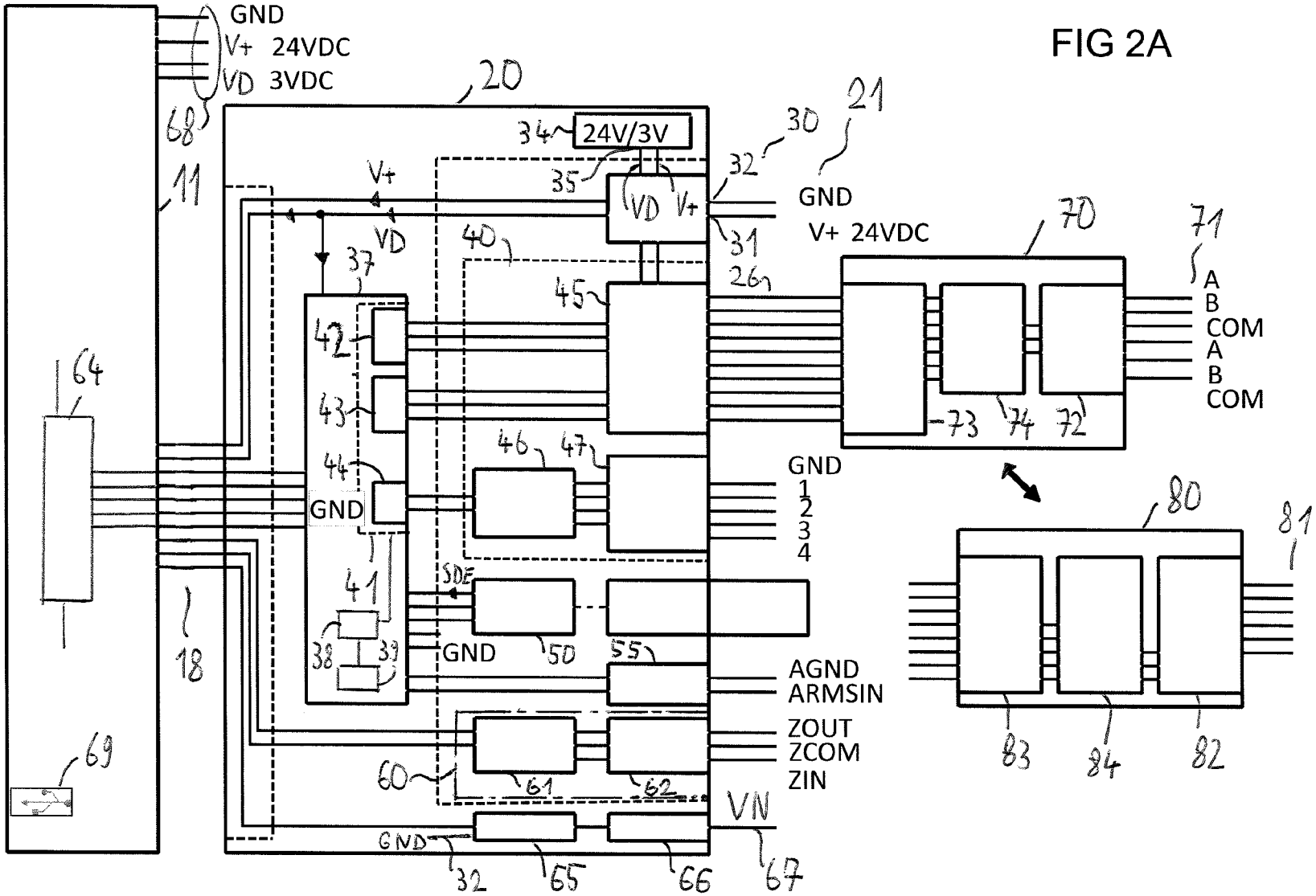
FIGS. 2A to 2C Examples of an interface module.

FIG. 2A shows an example of the interface module (20) as an improvement of the examples shown in FIGS. 1A and 1B. The interface module (20) comprises a signal processing unit (37). The signal processing unit (37) can be implemented as a microprocessor or micro-controller. The signal processing unit (37) comprises a central unit (38), or central processing unit, CPU, and a memory unit (39) as blocks.

The interface module (20) also comprises a power supply input (30). The power supply input (30) can have two power supply lines (31, 32). A first power supply line (31) can be provided to feed in a first power supply voltage V+. The first power supply voltage V+ is implemented as a DC voltage. The first power supply voltage V+ can have a value of 24 volts, for example. The second power supply line (32) can be implemented as a reference potential connection or reference potential line. A reference potential GND can be tapped from the second power supply line (32). The second power supply line (32) is connected to the signal processing unit (37) and the other circuits of the interface module (20) by way of various cables in the interface module (20). Further, the second power supply line (32) is connected to the triggering unit (11) by way of line arrangement (18).

The interface module (20) comprises a voltage converter (34), which is coupled to the power supply input (30). The voltage converter (34) comprises a power outlet (35). At the power outlet (35), a second supply voltage VD can be tapped. The power outlet 35 of the voltage converter 34 is connected to the signal processing unit (37). Further, the power outlet (35) of the voltage converter (32) is connected to the triggering unit (11) by way of lead configuration (18). In addition, the first power supply line (31) is connected to the triggering unit (11) by way of the lead configuration (18). Thus, the first supply voltage V+, the second supply voltage VD and the reference potential GND are fed to the triggering unit (11). The second supply voltage VD is a DC voltage. The second supply voltage VD has a lower voltage value than the first supply voltage V+. The second supply voltage VD can have a value of 3 volts, for example.

The interface module (20) comprises an interface circuit (40). The interface circuit (40) is connected to the connector ports (21), which lead out from the interface module (20). The interface circuit (40) is connected to the signal processing unit (37). The interface circuit (40) can be implemented as a media converter, interface converter or interface module, also called a transceiver. For example, a media converter can convert an electrical signal into an optical signal and vice versa.

The signal processing unit (37) also comprises a transmitting and receiving circuit (41). The transmitting and receiving circuit (41) comprises at least one transmitting and receiving unit (42 to 44). In the example shown in FIG. 2A, the transmitting and receiving circuit comprises three transmitting and receiving units (42 to 44). A transmitting and receiving unit (42) in the transmitting and receiving circuit (41) can be implemented as a universal asynchronous receiver-transmitter. A universal asynchronous receiver-transmitter is abbreviated to UART. Another transmitting and receiving unit (43) in the transmitting and receiving circuit can also be implemented as a universal synchronous/asynchronous receiver-transmitter. A universal synchronous/asynchronous receiver-transmitter is abbreviated to USART.

The interface circuit (40) couples the transmitting and receiving circuit (41) with the interface cables (26) in the interface module (20). To this end, the interface circuit (40) can comprise various blocks, such as a communication connection interface (45), also called a Comm. Connection Interface, which is connected to the transmitting and receiving units (42 and 43). Further, the interface circuit (40) can comprise a communication component (46), also called a CAM device, and an additional communication connection interface (47), also called a CAM connection interface. The other communication connection interface (47) is coupled to the transmitting and receiving unit (44) via the communication component (46).

The interface module (20) further comprises a detection unit (50). The detection unit (50) is connected to the signal processing unit (37). The detection unit (50) issues an electrical detection signal SDE to the signal processing unit (37). The detection unit (50) acts primarily as a position detector. The detection unit (50) can detect the position of the activator (22), for example. The detection unit (50) is used to detect the ON state, the OFF state and the trigger state of the switching device (20). The detection unit (50) can also be used to display the OFF state or the ON state. The detection unit (50) can be used to provide signals to a remote user.

The interface module (20) can comprise a control input circuit (55) which is coupled to the signal processing unit (37). A control signal ARMSIN is fed to the control input circuit (55). Also, another reference potential AGND can be fed to the control input circuit (55). The control input circuit (55) establishes a protective function in the switching device (10), in response to the control signal ARMSIN. A protective function can be set to high or low, for example. In the event of a high protective function, the voltage or current surge level at which the switching device (10) is triggered, i.e. at which the moving contact (17) is separated from the fixed contact (16), is low. So, for example, a high protective function is put in place when maintenance work is to be carried out on a load which is being fed with electrical energy through the switching device (10). The control signal ARMSIN can be generated by a person, by actuating a switch-off button on the switching device (10).

Also, the interface module (20) comprises an interlocking circuit (60). The interlocking circuit (60) can comprise an interlocking component (6)1 and an interlocking connection circuit (62). The interlocking circuit (60) is connected to the triggering unit (11) via a lead configuration (18) and connector ports (21) on the interface module (20). These connections are external connections. The interlocking circuit (60) implements the method of zone-selective interlocking. The interlocking circuit (60) can receive an interlocking input signal ZIN and issue an interlocking output signal ZOUT. Further, an additional interlocking signal ZCOM can be applied to the interlocking circuit (60).

Pursuant to the way zone-selective interlocking (ZSI) works, the switching device (10) closest to the load experiencing a fault is the device which is triggered. Thus, the switching device (10) that is triggered is the device which is directly upstream of the load. Other switching devices coupled to the load through the next switching device (10) do not trigger in the event of a fault, or at least are not the first to trigger. Thus, the other switching devices can continue to provide energy to other loads in a system. In a system, therefore, the loads or devices that are reduced, are those which are no longer supplied with energy in the event of a fault. Only when the switching device closest to the load is unable to handle the fault is another switching device triggered.

The interlocking circuit (60) provides information to the triggering unit (11) so that the triggering unit (11) can, by way of the switching mechanism (13) and the actuator (12), interrupt or continue current (I), depending on the state of the system.

In addition, the interface module (20) can comprise of a voltage divider (65). The voltage divider (65) can be connected to a neutral conductor by way of a voltage divider connection (66) and the connection cable (67). The voltage divider (65) can comprise of a first and a second voltage divider resistor. A voltage divider tap between the first and the second voltage divider resistor is connected to the triggering unit (11). A first connection of the voltage divider (65) is connected to the voltage divider connection (66) and can thus be connected to the neutral conductor as an option. A second connection of the voltage divider (65) is connected to the second power supply line (32). Thus, a voltage applied to the neutral conductor is stepped down and the stepped-down voltage which can be tapped at the voltage divider tap is fed to the triggering unit (11). If a voltage VN at the neutral conductor is above a pre-determined threshold, the triggering unit (11) triggers and interrupts the current (I).

The signal processing unit (37) is connected to the triggering unit (11) via a plurality of cables in the lead configuration (18). Thus, a plurality of cables leads from the interface module (20) to the triggering unit (11). The triggering unit (11) can comprise several connectors (68) through which, for example, the first supply voltage V+, the second supply voltage VD and the reference potential GND can be tapped. Thus, other modules in the switching device (10) can be supplied with the first and the second supply voltages V+, VD and the reference potential GND via the triggering unit (11) and the interface module (20).

The triggering unit (11) can comprise an additional signal processing unit (64). The additional signal processing unit (64) is coupled to the signal processing unit (37) of the interface module (20) and to the actuator (12). The additional signal processing unit (64) can comprise a microprocessor, a micro-controller, a logic gate and/or a state machine. The triggering unit (11) can comprise a USB interface (69).

In addition, the switching device (10) can comprise a bus module (70). The bus module (70) is connected to the interface module (20) and to the interface circuit (40) via the interface cables (26). The bus module (70) is connected to a bus (71) on the other side. The bus module (70) can be implemented as a Modbus module, a media converter, interface converter or interface module, also called a transceiver. The bus module (70) comprises a bus connection circuit (72) which is connected to the bus (70). Further, the bus module (70) also comprises an interface circuit (73) which is connected to the interface circuit (40) of interface module (20). For example, the interface circuit (73) of bus module (70) can be connected to the communication connection interface (45) of interface circuit (40). The interface circuit (73) of bus module (70) is coupled to bus connection circuit (72) via a bus converter (74) of bus module (70).

Instead of the bus (71), two or more buses can be connected to bus module (70). A plurality of connection cables can be used to connect the interface circuit (73) of bus module (70) to the communication connection interface (45) of interface circuit (40). The bus module (70) can be set up in the housing unit (23) of the switching device (10).

Alternatively, the switching device (10) can comprise an adapter module (80) for connecting a field bus (81) to the interface circuit (40). The adapter module (80) can be implemented as an external communication adapter module, a media converter, interface converter or interface module, also called a transceiver. The adapter module (80) comprises a field bus connection circuit (82) which is connected to the field bus (81). The adapter module (80) also comprises an interface circuit (83), which can be connected via the communication connection interface (45) of the interface circuit (40) in the interface module (20). A bus converter (84) in the adapter module (80) couples the interface circuit (43) in the adapter module (80) with the field bus connection circuit (82). The adapter module (80) can be set up in the housing (23) of the switching device (10).

In an alternative embodiment, the bus module (70) can be integrated into the interface module (20).

The interface module (70) is thus able to address one bus (71) or a plurality of buses.

In an alternative embodiment, the adapter module (80) can be implemented in the interface module (20). Thus, the interface module (20) can be connected to the field bus (81).

Figure 2B:
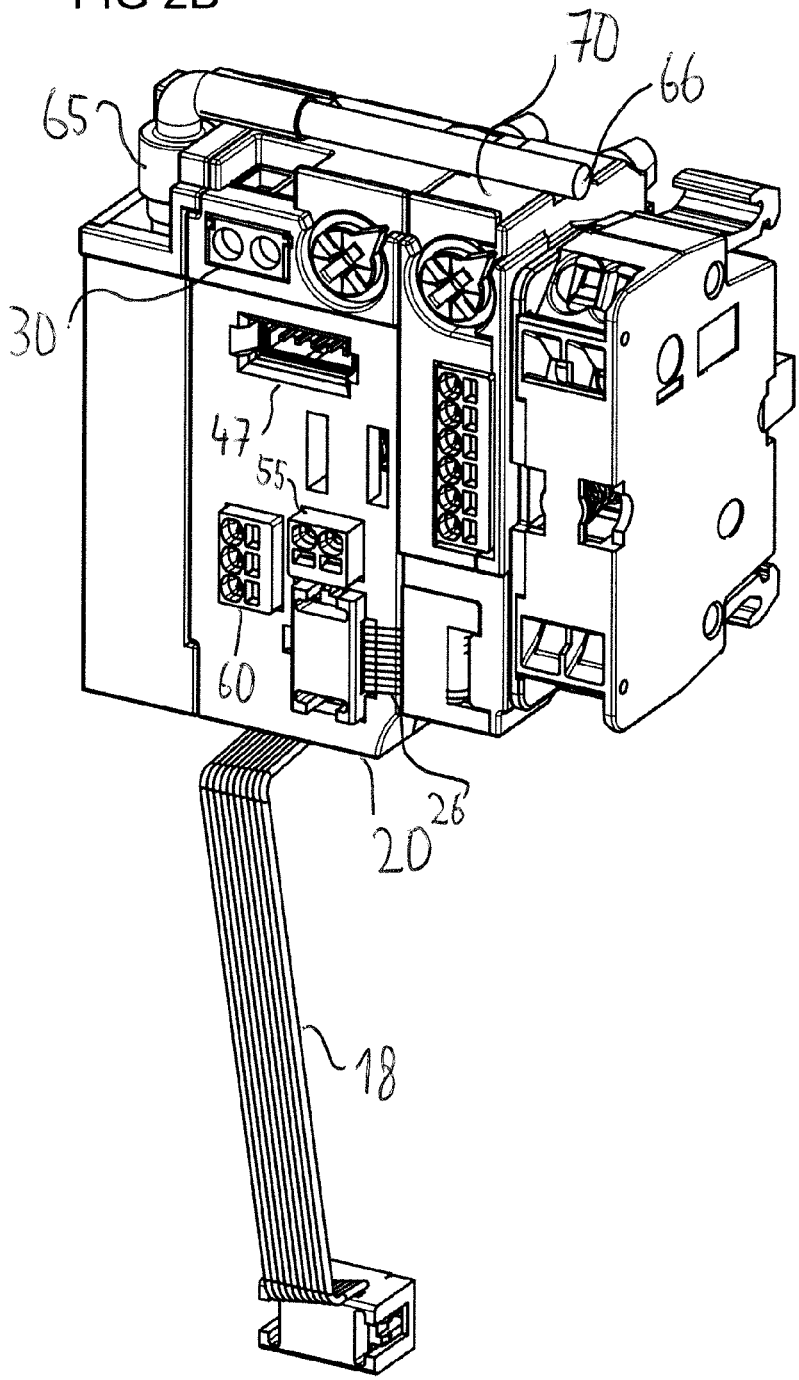

FIG. 2B shows an example of the interface module (10) from a perspective view, as an improvement of the examples shown above. It is shown primarily from the front side of the interface module (20). The interface module (20) comprises the voltage divider (65). The interface module (20) is connected to the triggering unit (11) via the lead configuration (18). The lead configuration (18) is implemented as a ribbon cable. The bus module (70) is placed adjacent to the interface module (20). The bus module (70) is coupled to the interface module (20) via the interface cables (26). The interface cables (26) are also implemented as a ribbon cable. The connectors for connecting the bus (71) to bus module (70) are also installed on the front side. Shown on the front side of the interface module (20) are the connections for the control input circuit (55), the interlocking circuit (60) and the additional communication connection interface (47). The interface module (20) includes a housing unit.

Figure 2C:
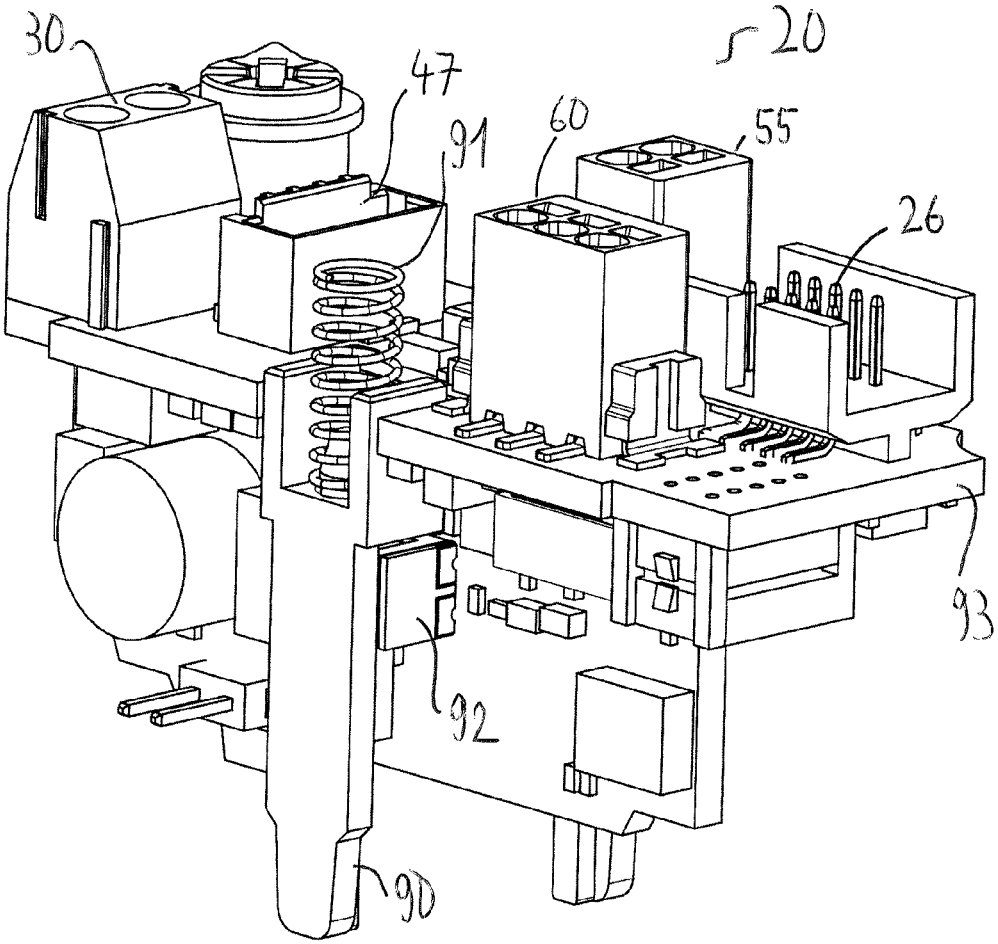

FIG. 2C shows an example of the interface module (20) from a perspective view, as an improvement of the examples shown above. Both a side view and a front view of the interface module (20) can be seen. The housing of the interface module (20) is removed. The switching mechanism (13) comprises a moving part (90). The moving part (90) can be coupled to the activator (22) shown in FIGS. 1A and 1B. The movement of the activator (22) is converted to a movement of the moving part (90). The switching mechanism (13) comprises a spring (91) which can be implemented as a compressed spring, for example. The spring (91) is installed between the housing or a support of the interface module (20) and the moving part (90). The moving part (90) can be cylindrical or cylindrical in sections.

To the side of the moving part (90), an optical detector (92) is installed in the interface module 20. The optical detector (92) is coupled to the detection unit (50). The optical detector (92) is used to optically detect the position of the moving part (90). The optical detector (92) issues a signal to the detection unit (50), which converts the signal into the electrical detection signal SDE. The optical detector (92) can be designed as a photomicrosensor or an infrared light barrier, for example. The interface module (20) can also comprise an optical detector 92. Alternatively, instead of optical detectors (92), one or more microswitches or one or more slot sensors in the interface module (20) can be included, to detect the position of the moving part (90).

The interface module (20) comprises a printed circuit board (93). The circuits of the interface module (20) can be installed on just one printed circuit board (93).

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE LIST

10 Switching device
11 Triggering unit
12 Actuator
13 Switching mechanism
14, 15 Connection
16 Fixed contact
17 Moving contact
18 Lead configuration
19 Extinguishing chamber
20 Interface module
21 Connector ports
22 Activator
23 Housing
24 Cover
25 Opening
26 Interface cables
27 Hinge
28 Additional housing
30 Power supply input
31 First power supply line
32 Second power supply line
34 Voltage converter
35 Power outlet
37 Signal processing unit
38 Central unit
39 Memory
40 Interface circuit
41 Transmitting and receiving circuit
42 to 44 Transmitting and receiving unit
45 Communication connection interface
46 Communication component
47 Additional communication connection interface
50 Detection unit
55 Control input circuit
60 Interlocking circuit
61 Interlocking component
62 Interlocking connection circuit
64 Additional signal processing unit
65 Voltage divider
66 Voltage divider connection
67 Connection line
68 Connections
69 USB interface
70 Bus module
71 Bus
72 Bus connection circuit
73 Interface circuit
74 Bus converter
80 Adapter module
81 Field bus
82 Field bus connection circuit
83 Interface circuit
84 Bus converter
90 Moving part
91 Spring
92 Optical detector
93 Printed circuit board
AGND Other reference potential
ARMSIN Control signal
I Current
GND Reference potential
SDE Electrical detection signal
VD Second supply voltage
VN Voltage
V+ First supply voltage
ZCOM Additional interlocking signal
ZIN Interlocking input signal
ZOUT Interlocking output signal

What is claimed is:

1. A switching device, comprising:
a housing;
a triggering unit;
an actuator coupled to the triggering unit;
a switching mechanism coupled to the actuator;
an adapter module;
an extinguishing chamber; and
an interface module, comprising:
a signal processing unit coupled to the triggering unit;
an interface circuit coupled to a transmitting and receiving circuit of the signal processing unit, the interface circuit comprising a communication connection interface, a CAM device, and a CAM connection interface;
a power supply input configured to feed a first supply voltage; and
a voltage converter connected on an input side to the power supply input and having a power outlet configured to issue a second supply voltage, the power outlet being coupled to the signal processing unit and to the triggering unit,
wherein the triggering unit, the actuator, the switching mechanism, and the interface module are installed inside the housing, and the triggering unit is configured to connect or disconnect a moving contact with a fixed contact,
wherein the extinguishing chamber is configured to extinguish a light arc between the moving contact and the fixed contact,
wherein the interface module is configured to be coupled to at least one of the adapter module or a bus module,
wherein the adapter module comprises a field bus connection circuit, an adapter module interface circuit, and a bus converter,
wherein the adapter module interface circuit is connected to the communication connection interface via an electrical line, and
wherein the interface module is removeably coupled to the triggering unit via a plug-in connector.

2. The switching device according to claim 1, wherein the signal processing unit comprises a micro-controller or a microprocessor.

3. The switching device according to claim 1, wherein the transmitting and receiving circuit of the signal processing unit is configured to convert a serial data signal to a parallel data signal.

4. The switching device according to claim 1, wherein the transmitting and receiving circuit of the signal processing unit comprises a universal asynchronous receiver-transmitter and/or a universal synchronous/asynchronous receiver-transmitter.

5. The switching device according to claim 1, wherein the voltage converter comprises a DC/DC converter, and wherein a voltage value of the first supply voltage is greater than a voltage value of the second supply voltage.

6. The switching device according to claim 1, wherein the interface module comprises a detection unit, which is coupled to the signal processing unit on an output side and is configured to convert position information into an electrical detection signal.

7. The switching device according to claim 6, wherein the detection unit is configured to optically detect a position of an activator of the switching device and to convert the position into the electrical detection signal.

8. The switching device according to claim 1, wherein the interface module comprises a voltage divider with a first connection, a second connection, and a voltage divider tap, and wherein the first connection is connectable to a neutral conductor and the voltage divider tap is coupled to an input of the triggering unit.

9. The switching device according to claim 1, wherein the interface module comprises a control input circuit configured to feed a control signal, and wherein the signal processing unit is coupled to the control input circuit and is configured to establish a protection function of the switching device depending on the control signal.

10. The switching device according to claim 1, wherein the interface module comprises an interlocking circuit, the interlocking circuit being coupled to a connection in the interface module, the interlocking circuit being configured to receive and/or transmit an interlocking signal, the interlocking circuit being connected to the triggering unit so that the triggering unit is configured to interrupt or enable a current using the actuator and the switching mechanism depending on the interlocking signal.

11. The switching device according to claim 1, wherein the triggering unit comprises an additional signal processing unit which is coupled to the signal processing unit of the interface module and to the actuator, and comprises a microprocessor, a micro-controller, a logic gate, and/or a state machine.

12. The switching device according to claim 1, wherein the adapter module is implemented as an external communication adapter module, a media converter, or an interface converter or interface module.

13. The switching device according to claim 1, wherein the bus converter couples the adapter module interface circuit with the field bus connection circuit.

14. The switching device according to claim 1, wherein the adapter module is installed inside the housing.

15. The switching device according to claim 1, further comprising:

an additional housing removeably fastened to the housing, wherein the additional housing houses at least one of the bus module or the adapter module, and wherein the interface module is removeably coupled to at least one of the adapter module or the bus module.

16. The switching device according to claim 1, wherein the interface module is configured to be removable from the switching device in a condition where the switching device is in an installed arrangement, and wherein the housing is configured to be opened in the condition where the switching device is in the installed arrangement to allow removal of the interface module.

17. The switching device according to claim 1, wherein the adapter module and the bus module are configured to be swappable such that the interface module is selectively coupleable to the adapter module or the bus module.

18. A switching device, comprising:

a housing;

a triggering unit;

an actuator coupled to the triggering unit;

a switching mechanism coupled to the actuator;

an adapter module; and an interface module, comprising:

a signal processing unit coupled to the triggering unit;

an interface circuit coupled to a transmitting and receiving circuit of the signal processing unit, the interface circuit comprising a communication connection interface, a CAM device, and a CAM connection interface;

a power supply input configured to feed a first supply voltage; and a voltage converter connected on an input side to the power supply input and having a power outlet configured to issue a second supply voltage, the power outlet being coupled to the signal processing unit and to the triggering unit, wherein the triggering unit comprises an additional signal processing unit which is coupled to the signal processing unit of the interface module and to the actuator, and comprises a microprocessor, a micro-controller, a logic gate, and/or a state machine, wherein the triggering unit, the actuator, the switching mechanism, and the interface module are installed inside the housing, wherein the interface module is configured to be coupled to at least one of the adapter module or a bus module, wherein the adapter module comprises a field bus connection circuit, an adapter module interface circuit, and a bus converter, wherein the adapter module interface circuit is connected to the communication connection interface via an electrical line, and wherein the interface module is removeably coupled to the triggering unit via a plug-in connector.

19. A switching device, comprising:

a housing;

a triggering unit;

an actuator coupled to the triggering unit;

a switching mechanism coupled to the actuator;

an adapter module; and an interface module, comprising:

a signal processing unit coupled to the triggering unit;

an interface circuit coupled to a transmitting and receiving circuit of the signal processing unit, the interface circuit comprising a communication connection interface, a CAM device, and a CAM connection interface;

a power supply input configured to feed a first supply voltage;

a voltage converter connected on an input side to the power supply input and having a power outlet configured to issue a second supply voltage, the power outlet being coupled to the signal processing unit and to the triggering unit;

control input circuit coupled to the signal processing unit, wherein the triggering unit, the actuator, the switching mechanism, and the interface module are installed inside the housing, wherein the first supply voltage, the second supply voltage, and a reference potential are coupled to the triggering unit;

wherein the control input circuit sets a threshold at which the switching device is triggered based on an input received at the interface module, wherein the interface module is configured to be coupled to at least one of the adapter module or a bus module, wherein the adapter module comprises an adapter module interface circuit that couples the communication connection interface with a field bus using a bus convertor that couples the adapter module interface circuit with a field bus connection circuit, and the field bus connection circuit couples the bus converter with the field bus, and wherein the interface module is configured to be removable from the switching device in a condition where the switching device is in an installed arrangement, and wherein the housing is configured to be opened in the condition where the switching device is in the installed arrangement to allow removal of the interface module.

* * * * *